US012677967B2

(12) United States Patent
Wang

(10) Patent No.: US 12,677,967 B2
(45) Date of Patent: Jul. 14, 2026

(54) MODULAR DRINKWARE

(71) Applicant: Zheng Wang, Aurora (CA)

(72) Inventor: Zheng Wang, Aurora (CA)

( * ) Notice: Subject to any disclaimer, the term of this patent is extended or adjusted under 35 U.S.C. 154(b) by 0 days.

(21) Appl. No.: 18/212,611

(22) Filed: Jun. 21, 2023

(65) Prior Publication Data

US 2024/0423395 A1 Dec. 26, 2024

(51) Int. Cl.
*A47G 19/22* (2006.01)

(52) U.S. Cl.
CPC ..... *A47G 19/2227* (2013.01); *A47G 19/2288* (2013.01); *A47G 2019/2238* (2013.01); *A47G 2019/225* (2013.01)

(58) Field of Classification Search
CPC ..... A47G 19/2227; A47G 19/2288; A47G 2019/2238; A47G 2019/225
USPC ..... 215/365; 220/4.26
See application file for complete search history.

(56) References Cited

U.S. PATENT DOCUMENTS 7,175,294 B1 * 2/2007 Estrada ..... F21V 33/0024 362/101
2009/0080180 A1 * 3/2009 Bertken ..... B65D 41/04 220/729
2019/0357707 A1 * 11/2019 Bugaj ..... A47G 19/2227
2022/0218137 A1 * 7/2022 Iverson ..... G01G 23/365
2022/0361695 A1 * 11/2022 Alexander ..... A47J 41/0044
2023/0320504 A1 * 10/2023 Lovern ..... A47G 19/2227 220/703
2024/0108166 A1 * 4/2024 Walsh ..... B65D 81/3876

FOREIGN PATENT DOCUMENTS

CN 105725652 A * 7/2016
CN 105962714 A * 9/2016
CN 106389131 A * 2/2017
CN 107744308 A * 3/2018 ..... A47G 19/2227
CN 110859472 A * 3/2020
CN 112690626 A * 4/2021 ..... A47G 19/2211

* cited by examiner

*Primary Examiner* — Orlando E Aviles
*Assistant Examiner* — Niki M Eloshway
(74) *Attorney, Agent, or Firm* — Capehart Law Firm

(57) ABSTRACT

A modular drinkware system includes a beverage container, a plurality of modules and in some embodiments, a software application. Each module is preferably reusable and able to be used alone with the beverage container or combined and connected to each other using mechanical connectors. Further, each module can be connected together electrically so that sensor data (or other data) can be shared between the modules and an external computing device via the software application. The plurality of modules apply a variety of different functions to the beverage container, such as sensing temperature of a beverage inside the beverage container, sensing fill time of the beverage, sensing fill level of the beverage, heating the beverage, and displaying or otherwise indicating information relating to the beverage.

17 Claims, 12 Drawing Sheets

MODULAR DRINKWARE

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of beverage containers of existing art and more specifically relates to a beverage container with interchangeable functional modules.

RELATED ART

Beverage bottles are ubiquitous items in modern society. They are primarily used to store and transport a variety of beverages, including water, soft drinks, juices, and alcoholic beverages; and are provided in many different shapes and sizes, from small plastic water bottles to large glass wine bottles. One of the main benefits of beverage bottles is their convenience, as they allow individuals to easily carry drinks with them wherever they go. Further, beverage bottles are generally also environmentally friendly, as they can be reused multiple times and are often recyclable.

However, there are problems with current beverage bottles in the art. Notably, current beverage bottles are either designed for general use with a variety of beverages and as such, fail to meet specific needs of different types of drinks and situations; or they are specifically designed for a particular type of beverage and as such are unsuitable for other types of beverages. For example, bottles with heating elements may be helpful when transporting heated drinks but are not suitable for cold beverages. Similarly, if a bottle is designed specifically for cold drinks, it may not be effective for keeping hot drinks at the desired temperature. This lack of flexibility in design can lead to frustration and inconvenience for consumers. As such, a suitable solution is desired.

SUMMARY OF THE INVENTION

In view of the foregoing disadvantages inherent in the known beverage container art, the present disclosure provides novel modular drinkware. The general purpose of the present disclosure, which will be described subsequently in greater detail, is to provide a beverage container system with a plurality of modules that can be used simultaneously together with the beverage container or any other combination to apply different functions to the beverage container (and to a beverage contained inside).

A modular drinkware system is disclosed herein. According to some embodiments, the modular drinkware system may include a beverage container and a plurality of modules. The modular drinkware system may preferably be configured to operate with two or more modules from the plurality of modules. The beverage container may include an interior for holding a beverage, and a top end opposite a bottom end. The top end may include a first container connector and the bottom end may include a second container connector.

The plurality of modules may each include first module connector at a top thereof and/or a second module connector at a bottom thereof enabling any of the plurality of modules to independently connect to the top end and/or the bottom end of the beverage container mechanically via the first container connector and the second container connector, respectively. Also, the first module connector/second module connector may enable the plurality of modules to be removably connected to each other mechanically. Each module may be configured to perform at least one respective electrical function, and at least one of the at least two modules may include a power source to provide power for the electrical function.

According to another embodiment, a modular drinkware system may include a beverage container, at least one functional module and at least one core module. Similar to above, the beverage container may include an interior for holding a beverage, and a top end opposite a bottom end; the top end including a first container connector and the bottom end including a second container connector.

The at least one functional module and at least one core module may each include an electronic connector configured to electrically connect the modules together, a first module connector at a top thereof and/or a second module connector at a bottom thereof enabling any of the at least one functional module and the at least one core module to independently connect to one of the top end and the bottom end of the beverage container mechanically via the first container connector and the second container connector respectively, and enabling the at least one functional module and the at least one core module to be removably connected to each other mechanically. The at least one functional module may be configured to perform at least one electrical function chosen from the group consisting of sensing at least one condition of the beverage, manipulating the at least one condition of the beverage, indicating the at least one condition of the beverage, and combinations thereof; and the at least one core module may include a power source to provide power for the electrical function.

According to another embodiment, a modular drinkware system may include a beverage container, a plurality of modules and a software application. Again, as above, the modular drinkware system may function with two or more of the plurality of modules. The beverage container may include an interior for holding a beverage, and a top end opposite a bottom end; the top end may include a first container connector and the bottom end may include a second container connector.

The plurality of modules may each include a first module connector at a top thereof and/or a second module connector at a bottom thereof enabling any of the plurality of modules to independently connect to the top end and/or the bottom end of the beverage container mechanically via the first container connector and the second container connector, respectively. Also, the first module connector/second module connector may enable the plurality of modules to be removably connected to each other mechanically. Each module may be configured to perform at least one respective electrical function, and at least one of the at least two modules may include a power source to provide power for the electrical function.

Further, at least one of the modules may include a wireless receiver and/or a wireless transmitter configured to wirelessly connect with an external computing device. The software application may be downloadable to (or otherwise usable on) the external computing device and configured to communicate with the one of the modules. Particularly, the software application may enable parameters to be set relating to the at least one condition of the beverage in the beverage container, and when a parameter is met, an alert may be indicated (displayed) on (at least) the external computing device.

For the purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments for the present disclosure, a modular drinkware system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to beverage containers and more particularly to modular drinkware. Generally, the modular drinkware may include a plurality of modules, with each module designed to be reusable and able to be combined and connected to each other and to a beverage container using mechanical connectors (for example, using a screw mechanism). The plurality of modules may also be connected electrically so that sensor data (or other data) may be shared between the modules using electronic connectors such as (but not limited to) pogo pin connectors, rail connectors and/or USB-C connectors. Alternatively, the modules may be used on their own with the beverage container.

One or more of the modules may also communicate with an external computing device or software application on the external computing device to relay information from the modules to the external computing device and/or command the modules to perform specific tasks, such as (but not limited to) sensing temperature, fill time of a beverage into the beverage container and fill level of the beverage; heating the beverage; and displaying information regarding the beverage (such as temperature, fill time, fill level, etc.)

Referring now more specifically to the drawings by numerals of reference, there is shown in FIGS. 1-14, various views of a modular drinkware system 100. As shown in these figures, the modular drinkware system 100 may comprise a beverage container 110 and a plurality of modules 120. Preferably, the modular drinkware system 100 may be configured to operate with at least two or any combination of modules from the plurality of modules 120. For example, two modules 120 may be attached to the beverage container 110, all of the modules 120 may be attached, or some of the modules 120 may be attached.

As above, each of the modules 120 may perform different electrical function(s) than the other; and as such, a particular module 120 may be chosen for attachment to the beverage container 110 based on a user's desire for that particular function (for example, a module having heating function may be chosen when the user wants to heat their beverage). The plurality of modules 120 may be placed in a particular order, or may be placed in random order, again according to user preference.

Figure 1:
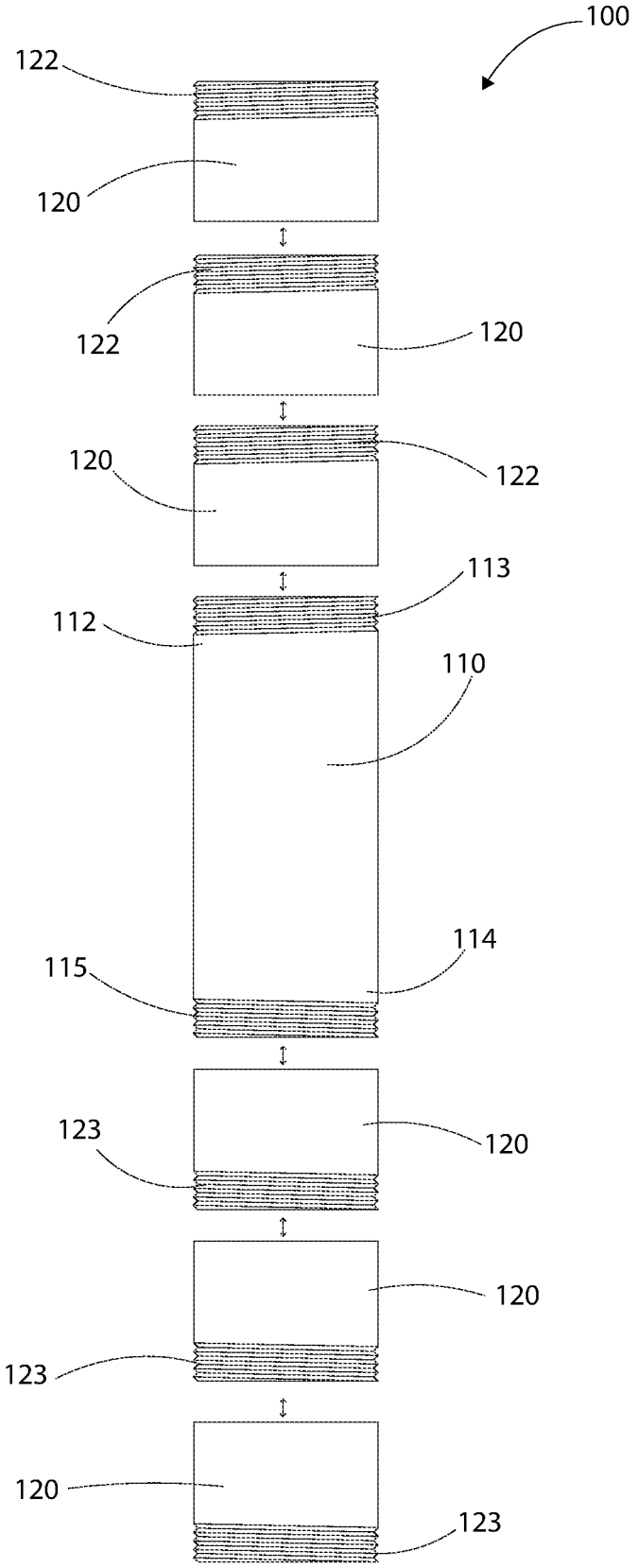
FIG. 1 is an exploded view of a modular drinkware system including a beverage container and a plurality of modules, according to an embodiment of the disclosure.
Figure 2:
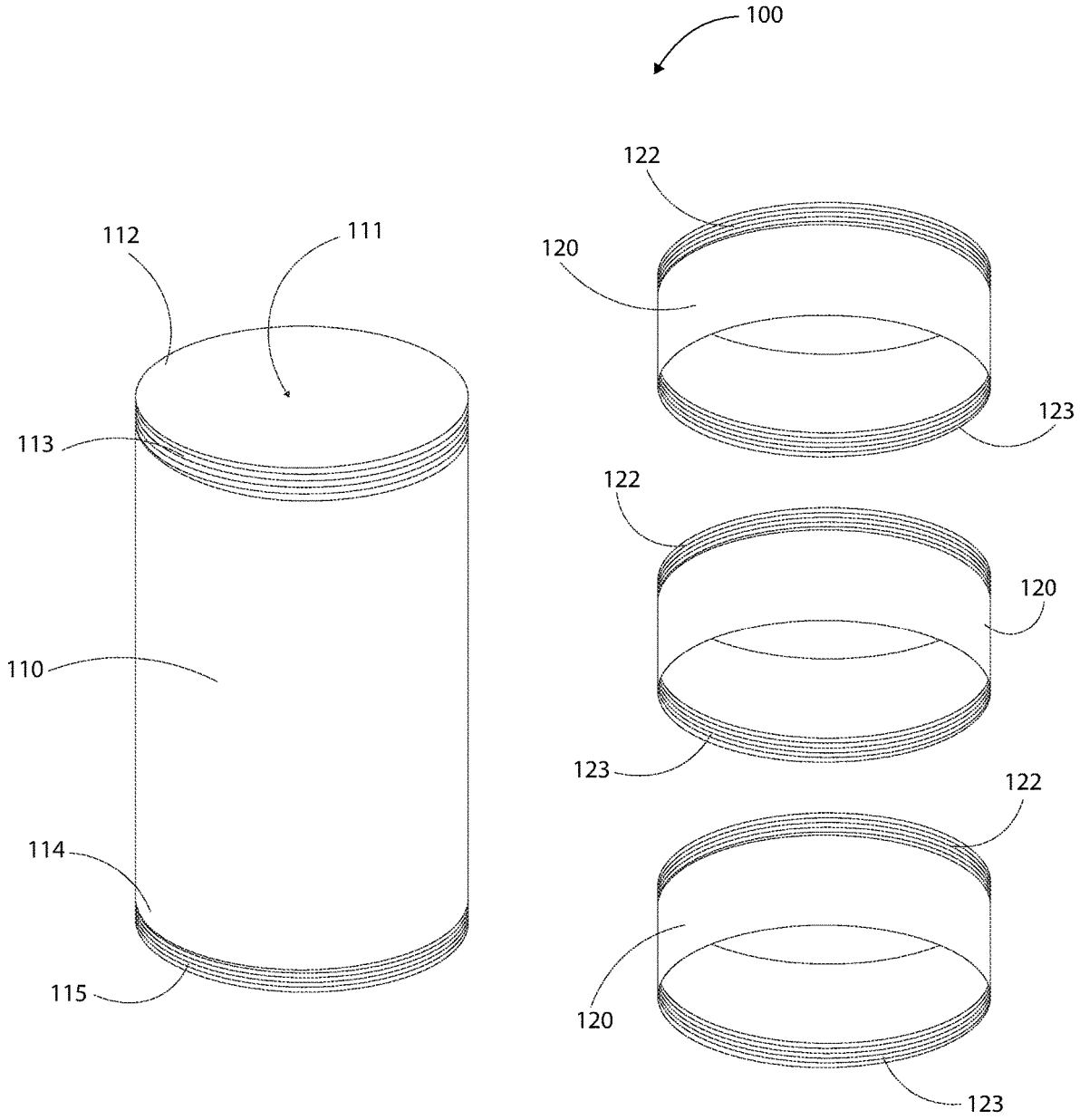
FIG. 2 is a perspective view of the beverage container and the plurality of modules, according to an embodiment of the present disclosure.

Referring specifically to FIGS. 1-2, as shown, the beverage container 110 may include an interior 111 for holding a beverage and a top end 112 opposite a bottom end 114. The top end 112 may include a first container connector 113 and the bottom end 114 may include a second container connector 115 enabling the plurality of modules 120 to fasten to the beverage container 110. Accordingly, the plurality of modules 120 may each include a first module connector 122 at a top thereof and/or a second module connector 123 at a bottom thereof, enabling any of the plurality of modules 120 to independently connect to the top end 112 or the bottom end 114 of the beverage container 110 mechanically via the first container connector 113 or the second container connector 115 respectively. Further, the module connectors 122, 123 may enable the plurality of modules 120 to be removably connected to each other mechanically. It should be appreciated that FIGS. 1-2 show example amounts of modules 120 for illustration purposes only and do not limit the plurality of modules 120 to a particular number.

In some embodiments, the first container connector 113 and the second container connector 115 may include threads, and the first module connector 122 and the second module connector 123 may include corresponding threads. For example, a first module may be attached directly to the beverage container 110 by screwing the second module connector 123 on the first module into the first container connector 113; and a second module may be attached to the first module by screwing the second module connector 123 on the second module into the first module connector 122 on the first module.

Figure 3:
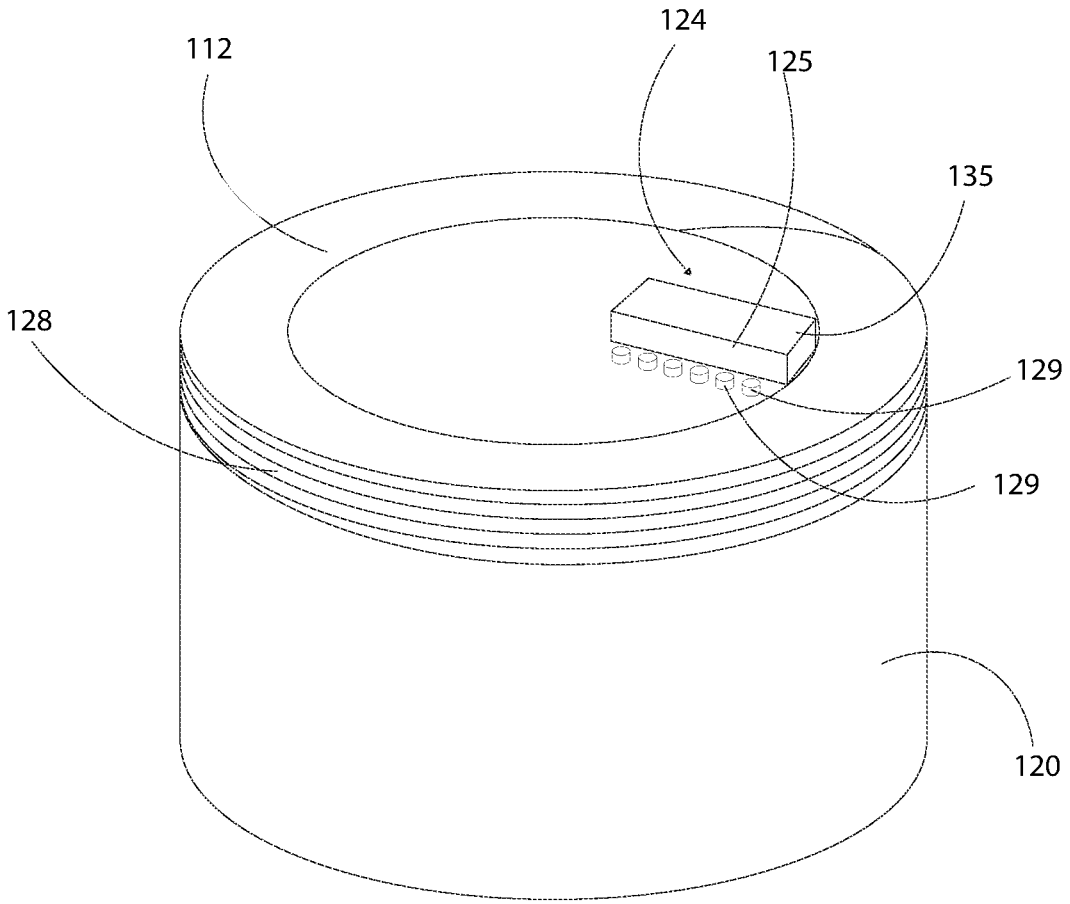
FIG. 3 is a side perspective view of a module including an electronic connector, the electronic connector being a pogo pin connector, according to an embodiment of the present disclosure.
Figure 4:
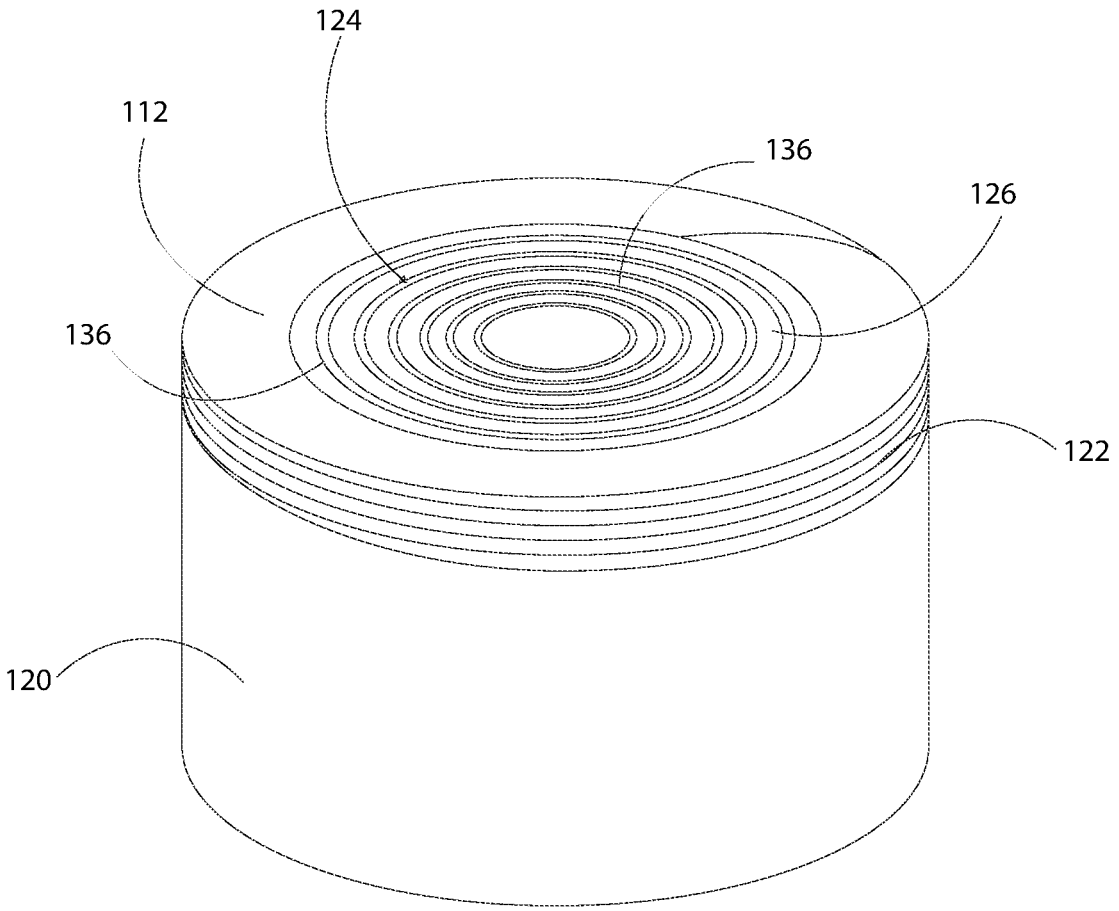
FIG. 4 is a side perspective view of the electronic connector being a rail connector, according to an embodiment of the present disclosure.
Figure 6:
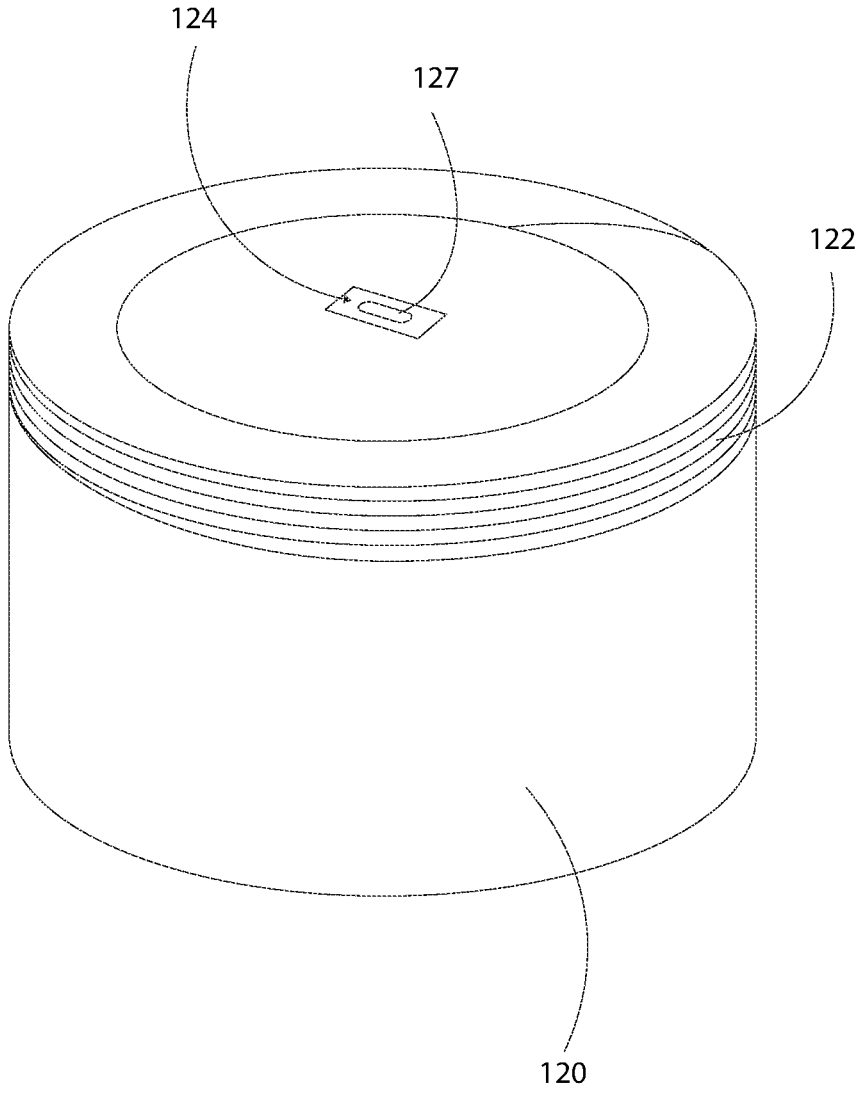
FIG. 6 is a side perspective view of the electronic connector being a USB-C connector, according to an embodiment of the present disclosure.
Figure 7:
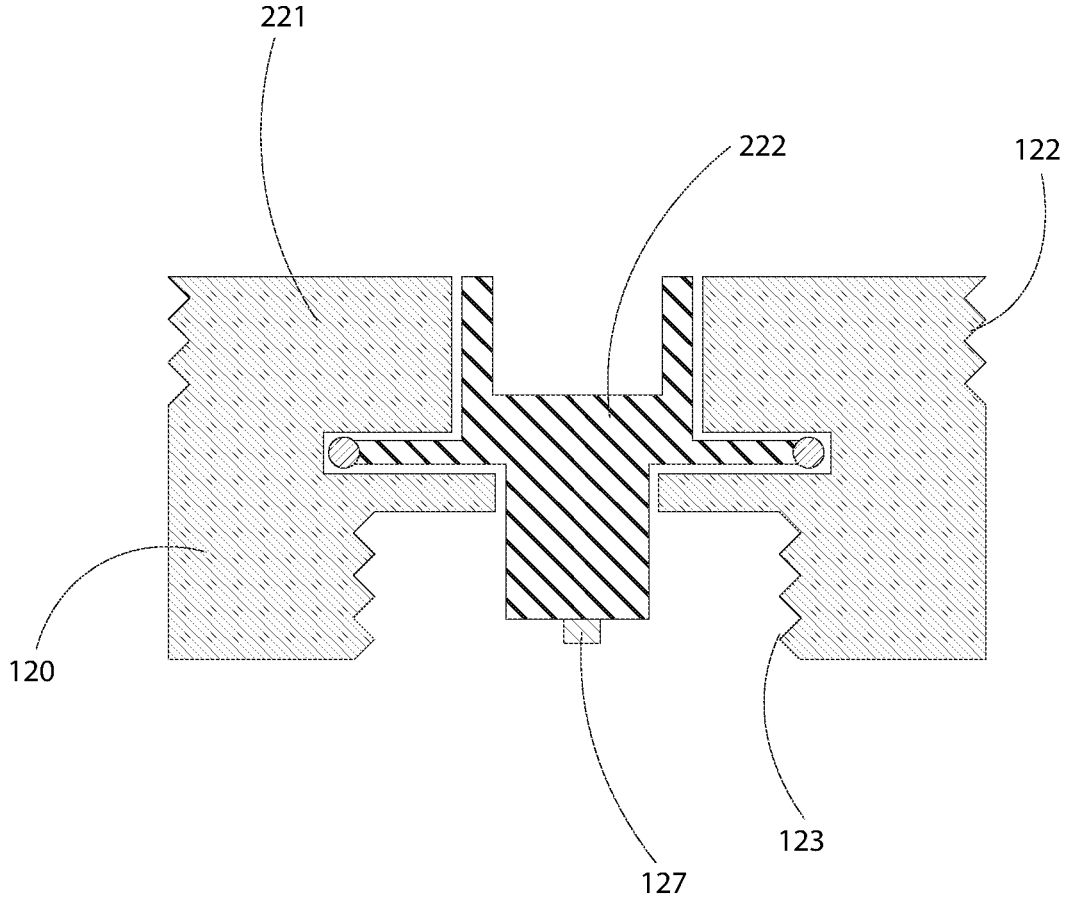
FIG. 7 is a cross-section view of the module with the USB-C connector and including an outer shell and an inner mechanism, according to an embodiment of the present disclosure.

The plurality of modules 120 may be configured to communicate with each other to send data between the modules 120. For example, a display module may be configured to receive data from a sensor module in order to display features (e.g., temperature, time it takes to fill, fill level) sensed from the sensor module. As such, as shown in FIGS. 3-7, in some embodiments, each of the modules may include an electronic connector 124 configured to electrically connect two or more of the plurality of modules 120 together. The electronic connector 124 may include (but is not limited to) a pogo pin connector 125, as shown in FIG. 3, a rail connector 126 as shown in FIG. 4, a USB-C connector 127, as shown in FIGS. 6-7 (and/or combinations thereof). Preferably, the electronic connector 124 may be placed on each of the modules 120 in such a location that when the plurality of modules 120 are mechanically connected, they automatically become electrically connected.

Figure 5:
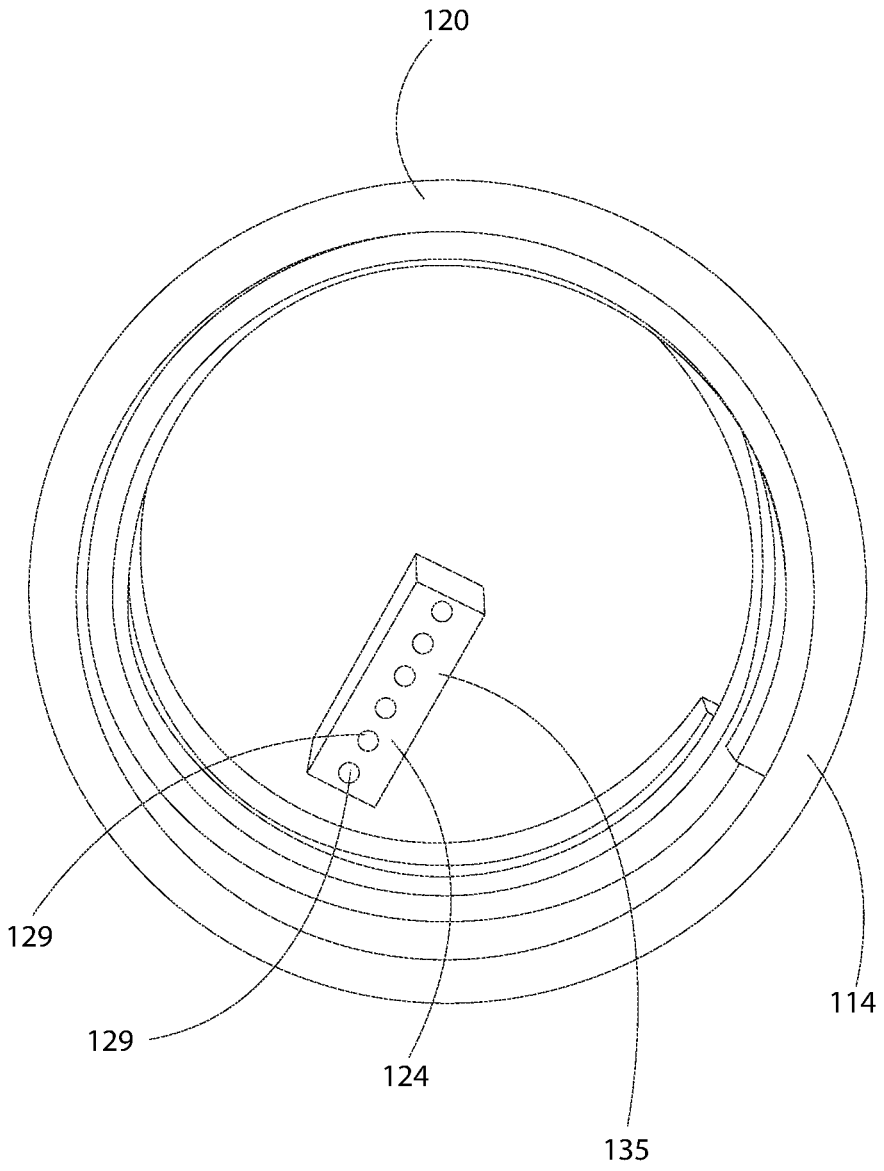
FIG. 5 is a bottom perspective view of a plurality of circular connectors and a cuboid block located at a bottom surface of a top side of the module, according to an embodiment of the present disclosure.

As shown in FIG. 3 and FIG. 5, the pogo pin connector 125 may include a plurality of circular connectors 129 and a cuboid block 135 at top and bottom surfaces of the top end 112; and the rail connector 126 may include the circular connectors 129 and the cuboid block 135 at the bottom surface of the top end 112 (as shown in the bottom view in FIG. 5) and a plurality of concentric circles 136 at the top surface of the top end 112, as shown in FIG. 4. It should be noted that FIG. 5 illustrates the bottom surface of the top end 112 for both the pogo pin connector 125 and the rail connector 126 embodiment as both are contemplated to be the same, however one figure is used to show this for the sake of brevity and redundancy.

In the pogo pin connector 125 embodiment shown in FIG. 3, the circular connectors 129 at the top surface of the top end 112 may be located next to the cuboid block 135. In this embodiment, the cuboid block 135 may act as a stopper to prevent the modules 120 from being rotated too far for the circular connectors 129 to be touching. As shown in FIG. 5, the circular connectors 129 may be attached on top of the cuboid block 135 at the bottom surface of the top end 112. In this embodiment, the heights of the cuboid blocks 135 may be designed in a way that enables the user to screw the modules 120 together by rotating two or three times, and then stop at the correct place to make the connectors 125 touch.

For the rail connector 126, as long as a radius of the plurality of concentric circles 136 is the same as the distances from the center to the circular connectors 129, the circular connectors 129 will remain connected to the plurality of concentric circles 136 and as such the cuboid block 135 is not needed on the top surface of the top side 112 as there is no potential for the modules 120 to be rotated too far for the circular connectors 129 to be touching.

In embodiments including the USB-C connector 127, to allow the modules 120 to twist (when screwing each module 120 into another module 120 or the beverage bottle 110) the module 120 may include an outer shell 221 and an inner mechanism 222 to which the USB-C connector 127 is connected, as shown in FIG. 7. Thus, the USB-C connector 127 is separated from the outer shell 221 and the outer shell 221 (and the module threads 128) are able to move independently from the USB-C connector 127.

As above, each of the modules 120 may perform one or more different functions than the other. Particularly, the plurality of modules 120 may each be operative to perform at least one respective function chosen from the group consisting of: sensing at least one condition of the beverage, manipulating the at least one condition of the beverage, indicating the at least one condition of the beverage, providing power to one or more of the modules, providing wireless connectivity to one or more of the modules, and/or combinations thereof. The at least one condition may be related to (but is not limited to) temperature, weight, filling time, fill level, etc.

In some embodiments, the plurality of modules 120 may include functional modules and core modules. For example, functional modules may include (but are not limited to) at least one module for sensing at least one condition of the beverage, at least one module for manipulating the at least one condition of the beverage, at least one module for indicating the at least one condition of the beverage, and/or a combination thereof. Core modules may include at least one module for providing wireless connectivity, at least one module for providing power, and/or combinations thereof.

Figure 8:
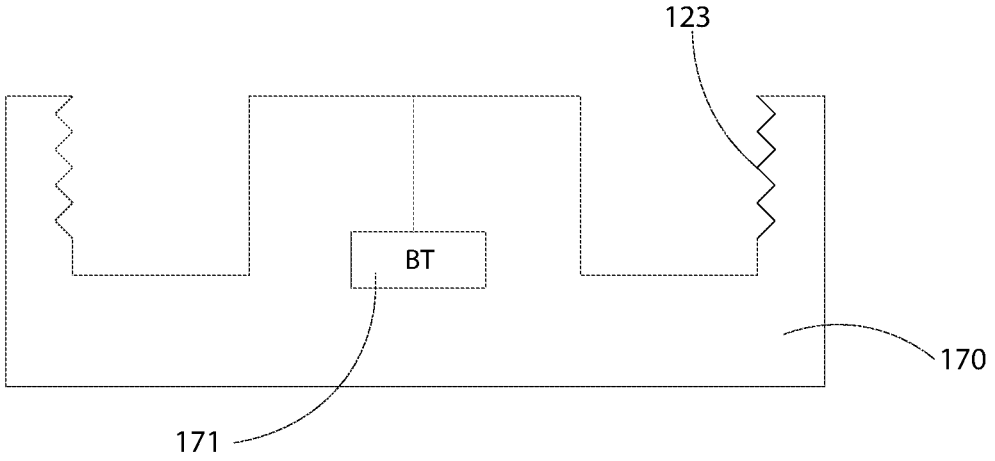
FIG. 8 is a schematic diagram of a module including a battery, according to an embodiment of the present disclosure.
Figure 9:
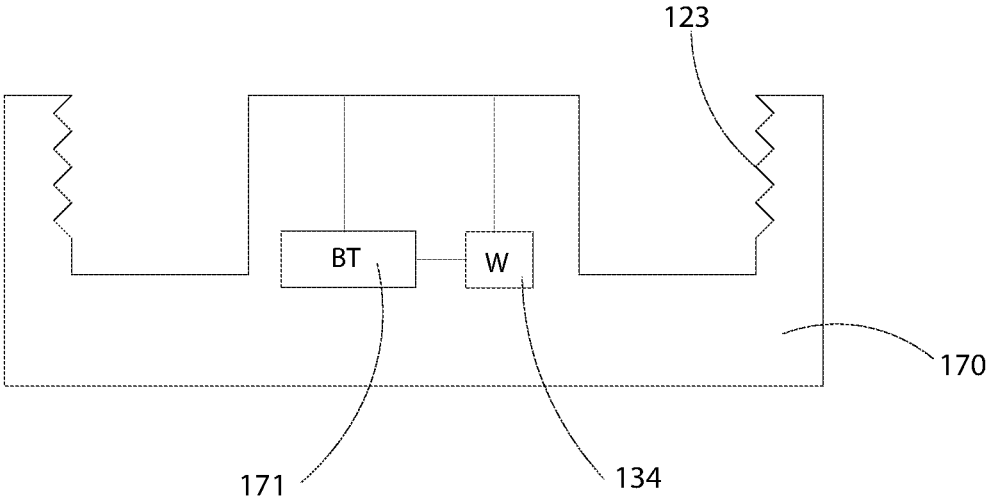
FIG. 9 is a schematic diagram of a module including the battery and a wireless communication unit, according to an embodiment of the present disclosure.

It is contemplated that the modular drinkware system 100 may function with at least two of the modules 120, where one of the modules 120 is a core module including at least one power source 171. For example, as shown in FIGS. 8-9, the plurality of modules 120 may include a (fourth) 'battery' module 170 including a power source 171, such as a battery, that is able to be electrically connected (either directly via connectors or indirectly via circuitry) to each module 120 attached to the beverage container 110, thus providing power thereto and powering the at least one electrical function.

In some embodiments, the power source 171 may be rechargeable and as such, fourth module 170 may include a charging port configured to receive a charging cable (not illustrated). In other embodiments, the fourth module 170 may include removable batteries such as (but not limited to) AA or AAA batteries. Further, in some embodiments, the plurality of modules 120 may include more than one battery module 170, allowing a user to interchange battery modules 170 when runs out of charge.

In addition, in some embodiments, at least one of the plurality of modules 120 may include a wireless communication unit 134 such as a wireless receiver, a wireless transmitter, and/or a wireless transceiver. For example, the wireless communication unit 134 may include (but is not limited to) a BLUETOOTH transceiver configured to wirelessly connect with an external computing device 5 (e.g., a smartphone). In some embodiments, as shown in FIG. 9, this may be provided as part of the battery module 170 (but is not limited to being part of the battery module 170).

Figure 10:
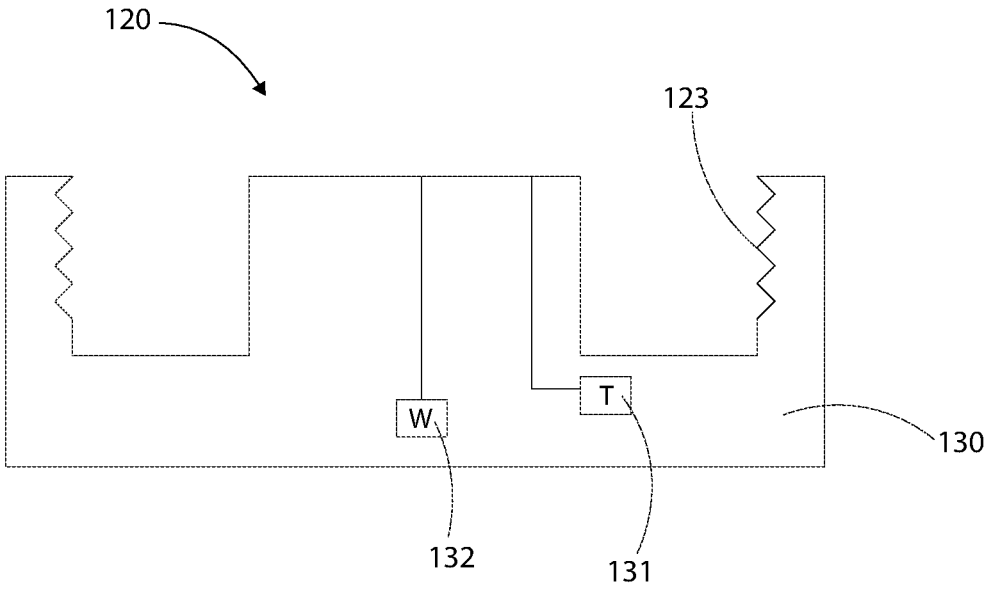
FIG. 10 is a schematic diagram of a module including a temperature sensor and a weight sensor, according to an embodiment of the present disclosure.
Figure 11:
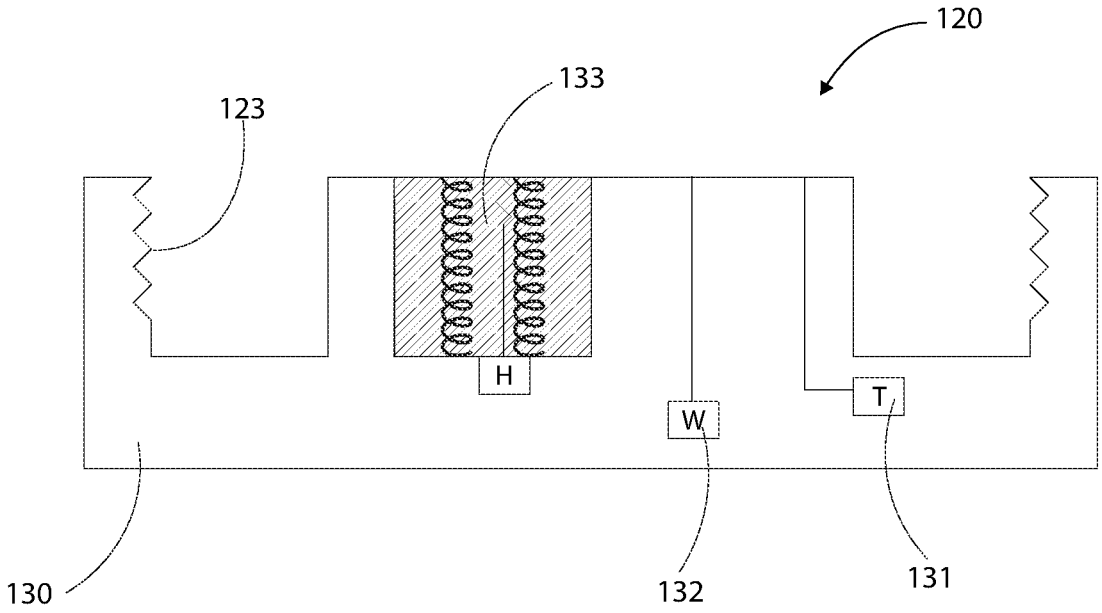
FIG. 11 is a schematic diagram of the module including the temperature sensor, the weight sensor and a heating element, according to an embodiment of the present disclosure.

Referring more specifically now to FIGS. 10-14, in some embodiments, the plurality of modules 120 may further include at least a first 'health' module 130 and a second 'display' module 140. As shown in FIGS. 10-11, the first module 130 may include at least one sensor configured to sense at least one condition of the beverage in the beverage container 110. Particularly, in some embodiments, the first module 130 may include a temperature sensor 131 configured to sense a temperature of the beverage. Further, the first module 130 may include a weight sensor 132 configured to sense a filling time of the beverage into the beverage container 110 and/or a fill level of the beverage.

Figure 12:
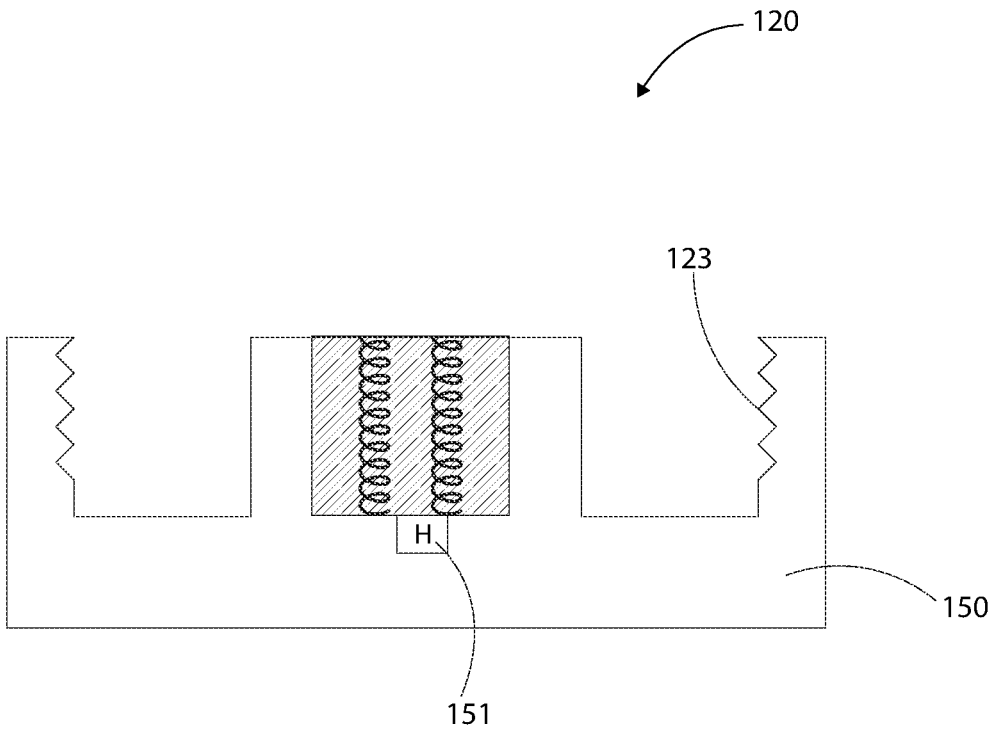
FIG. 12 is a schematic diagram of a module including a heating element, according to an embodiment of the present disclosure.

Further, in some embodiments, as shown in FIG. 11, the first module 130 may further include at least one element configured to manipulate the at least one condition of the beverage. For example, the first module 130 may include a heating element 133 configured to heat the beverage in the beverage container 110. In other embodiments, the heating element (or other element for manipulating the at least one condition of the beverage) may be provided separate to the first module 130 in one or more other modules, enabling the at least one element to be attached to the beverage container 110 separate to the temperature sensor 131/weight sensor 132. For example, as shown in FIG. 12, a heating element 151 may be provided in a third module 150. Further, in some embodiments, the temperature sensor 131 and weight sensor 132 may not be provided together and may instead be included in separate modules.

Figure 13:
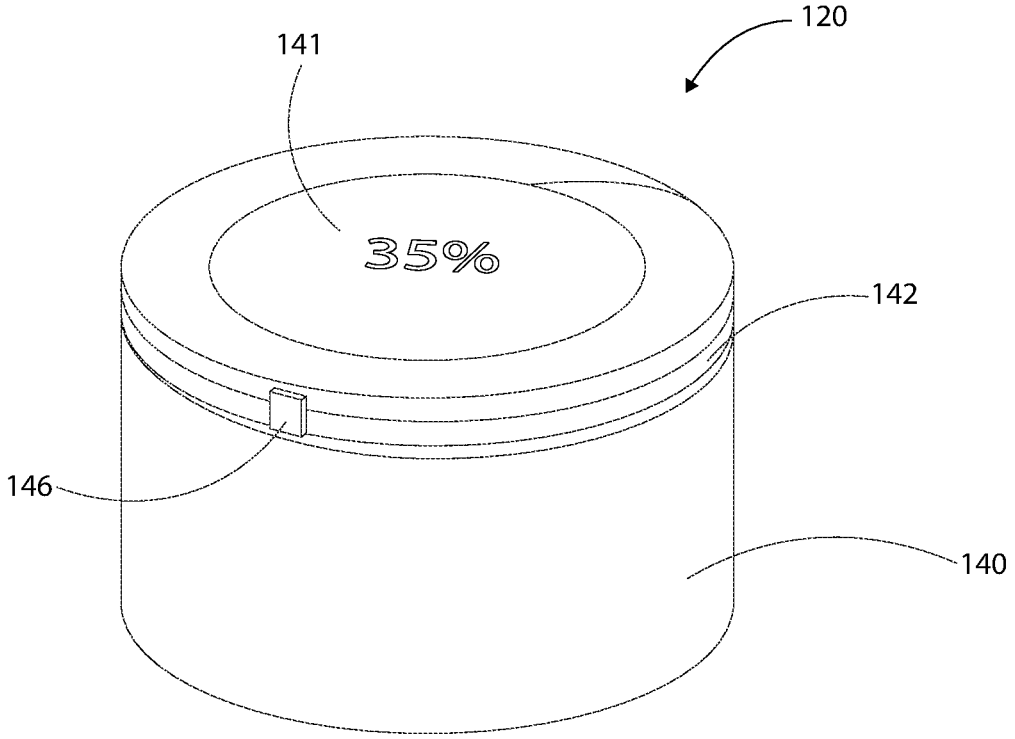
FIG. 13 is a side perspective view of a module including a display screen, a button, and an LED strip, according to an embodiment of the present disclosure.
Figure 14:
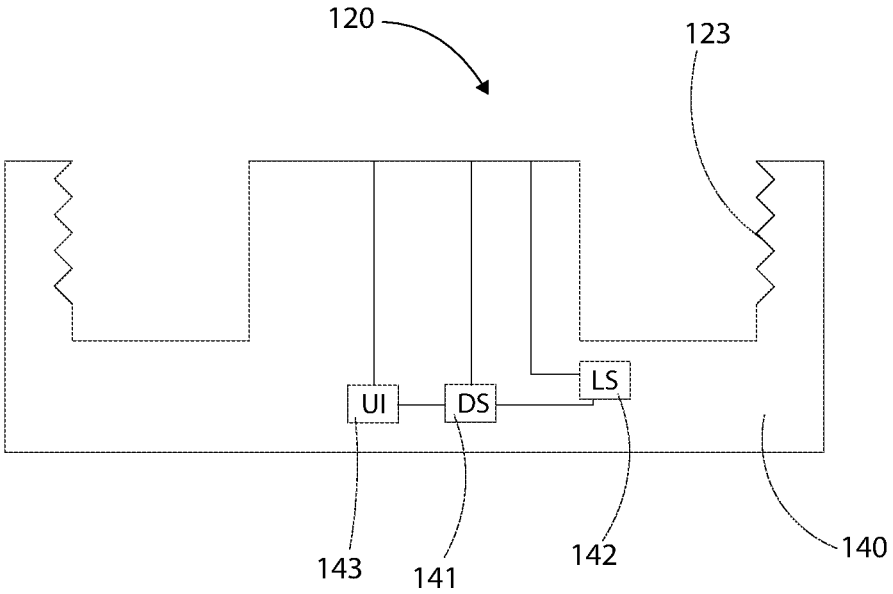
FIG. 14 is a schematic diagram of the module including the display screen, a user interface and the LED strip, according to an embodiment of the present disclosure.

In some embodiments, as shown in FIGS. 13-14, the second module 140 may include means of displaying or indicating the at least one condition of the beverage in the beverage container 110. For example, as shown in FIG. 13, the second module 140 may include a display screen 141 configured to display information relating to the at least one condition of the beverage. For example, the temperature of the beverage, the filling time of the beverage into the beverage container 110 and/or the fill level of the beverage. Further, the second module 140 may include a light-emitting diode (LED) strip 142 configured to emit at least two colored lights to indicate the at least one condition of the beverage. As shown in FIG. 13, the LED strip 142 may extend around a portion of a top periphery of the second module 140. The second module 140 may further include a user interface 143 (FIG. 14) enabling a user to change information displayed on the display screen 141. For example, as shown in FIG. 13, the user interface 143 may include one or more buttons 146. The user may utilize the user interface 143 to cycle through different screen layouts and to acknowledge message/alerts shown.

As above, in some embodiments, the plurality of modules 120 may be placed in random order. In other embodiments, some of the modules may be placed in a particular location on the beverage container 110. For example, the second module 140 including the display screen 141 may always be placed at the top of the beverage container 110. The module (s) containing the heating element 133 or 151, temperature sensor 131 and weight sensor 132 may always be placed directly onto the beverage container 110 (rather than indirectly attached via another module) to place the heating element 133 or 151, temperature sensor 131 and weight sensor 132 in direct contact with the beverage.

It should be appreciated that the plurality of modules 120 are not limited to the modules discussed and the modules discussed here are not limited to the particular components.

Figure 15:
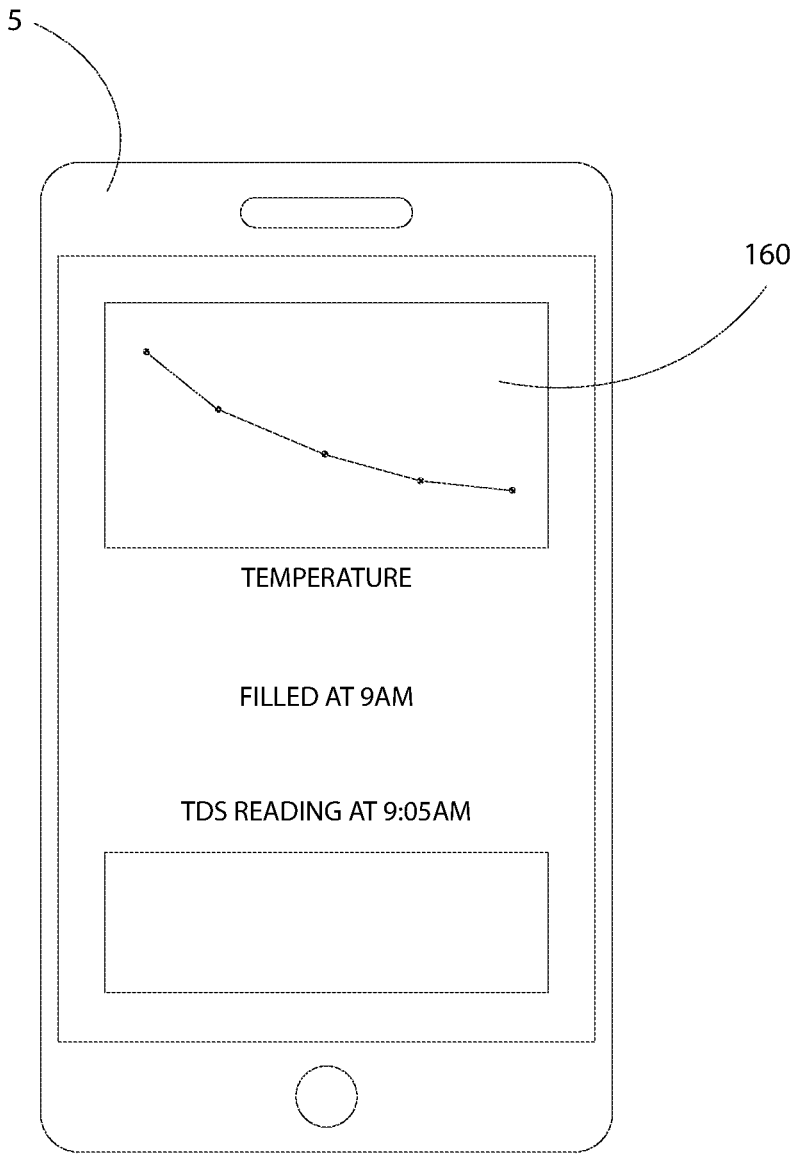
FIG. 15 is an example screen of a software application on an external computing device, according to an embodiment of the present disclosure.

As above, at least one of the plurality of modules 120 may include a wireless communication means such as a BLUETOOTH transceiver, transmitter and/or receiver 134 (FIG. 9) In addition, as shown in FIG. 15, the modular drinkware system 100 may further comprise a software application 160. The software application 160 may be downloadable to, or otherwise usable on, the external computing device 5. As such, the software application 160 may be used to communicate with the plurality of modules 120, and vice versa. In some embodiments, one or more controllers or processors/microprocessors (not illustrated) may be provided to facilitate communication between the software application 160 and the plurality of modules 120.

The software application 160 may enable parameters to be set relating to the at least one condition of the beverage, such as (but not limited to) the temperature of the beverage, the filling time of the beverage into the beverage container 110 and/or the fill level of the beverage. When a parameter is met, an alert may be indicated (i.e., displayed or shown) on the display screen 141, the external computing device 5 and/or the LED strip 142. For example, a particular temperature and/or a fill limit may be set via the software application 160 (by a user) and once the temperature or fill limit is met, the alert may be displayed on the display screen 141, the LED strip 142 and/or the external computing device 5.

The temperature sensor 131 may measure the temperature of the beverage periodically and send data to the software application 160, allowing the user to view information regarding the beverage (such as fill level, temperature, etc.) easily via the software application 160, and quickly by looking at the second module 140 (i.e., display screen 141 and/or LED strip 142). Further, the user may, via the software application 160, set a temperature limit. This may be useful for embodiments including the heating element 133 or 151, as once the beverage reaches below the temperature limit, the heating element 133 may begin to heat the beverage back to the set temperature limit. Further, in some embodiments, the display screen 141 or LED strip 142 on the second module 140 may be customized via the software application 160. In addition to this, the software application 160 may include templates (not illustrated) for standard daily beverages.

In use, the user may select one module or a combination of modules from the plurality of modules 120. The selected modules may be chosen based on their particular function, chosen from the group consisting of: sensing at least one condition of the beverage, manipulating the at least one condition of the beverage, indicating the at least one condition of the beverage, and/or a combination thereof. The user may then attach the one module or combination of modules directly to the beverage container 110 or to another module which is then directly attached to the beverage container 110.

It should be noted that, under appropriate circumstances, considering such issues as design preference, user preferences, marketing preferences, cost, structural requirements, available materials, technological advances, etc., other methods are taught herein.

It should be understood by one of skill in the art that the disclosed invention is described here in a few exemplary embodiments of many. No particular terminology or description should be considered limiting on the disclosure or the scope of any claims issuing therefrom.

It should also be noted that, in this specification and the drawings, some elements that have substantially the same function and structure are denoted with the same reference signs, and repeated explanation omitted. It should also be appreciated that common but well understood elements that are useful or necessary in a commercially feasible embodiment are often not depicted throughout in order to facilitate a clearer view of the various embodiments of the present invention.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the relevant patent offices and the public generally, and especially the scientist, engineers and practitioners in the art who are not familiar with patent or legal terms or phraseology, to determine quickly from a cursory inspection the nature and essence of the technical disclosure of the application.

What is claimed is:

1. A modular drinkware system comprising:

a beverage container including an interior for holding a beverage, and a top end opposite a bottom end, the top end including a first container connector and the bottom end including a second container connector; and a plurality of modules, each module from the plurality of modules include an electronic connector configured to electrically connect two or more of the plurality of modules together in order for each module of the plurality of modules to perform at least one respective electrical function, each module from the plurality of modules including at least one of a first module connector at a top thereof and a second module connector at a bottom thereof enabling any of the plurality of modules to independently and removably connect to one of the top end, the bottom end of the beverage container, and another of the plurality of modules mechanically and electrically connected via the first container connector and the second container connector respectively, and wherein at least one of the modules from the plurality of modules includes a power source to provide power for the electrical function, wherein the plurality of modules includes a first module, the first module including a temperature sensor configured to sense a temperature of the beverage, wherein each module of the plurality of modules are configured to communicate with the remaining modules to send data between the plurality of modules.

2. The modular drinkware system of claim 1, wherein the at least one respective electrical function is chosen from the group consisting of: sensing at least one condition of the beverage, manipulating the at least one condition of the beverage, indicating the at least one condition of the beverage, providing power to one or more of the plurality of modules, providing wireless connectivity to one of more of the plurality of modules, and combinations thereof.

3. The modular drinkware system of claim 1, wherein the first module further includes a weight sensor configured to sense at least one of a filling time of the beverage into the beverage container and a fill level of the beverage.

4. The modular drinkware system of claim 3, wherein the first module further includes a heating element configured to heat the beverage in the beverage container.

5. The modular drinkware system of claim 1, wherein the plurality of modules further includes a third module, and wherein the third module includes a heating element configured to heat the beverage in the beverage container.

6. The modular drinkware system of claim 1, wherein the plurality of modules further includes a second module, the second module including a display screen configured to display information relating to the at least one condition of the beverage, and a user interface enabling a user to change information displayed on the display screen.

7. The modular drinkware system of claim 6, wherein the second module further includes a light emitting diode (LED) strip configured to emit at least two colored lights to indicate the at least one condition of the beverage.

8. The modular drinkware system of claim 1, further comprising a fourth module including a power source configured to provide power to one or more of the plurality of modules.

9. The modular drinkware system of claim 1, wherein at least one of the plurality of modules includes at least one of a wireless receiver and a wireless transmitter configured to wirelessly connect with an external computing device.

10. The modular drinkware system of claim 9, further comprising a software application downloadable to the external computing device and configured to communicate with the plurality of modules, wherein the software application enables parameters to be set relating to the at least one condition of the beverage, and wherein when a parameter is met, an alert is indicated on at least one of the display screen, the LED strip and the external computing device.

11. A modular drinkware system comprising:

a beverage container including an interior for holding a beverage, and a top end opposite a bottom end, the top end including a first container connector and the bottom end including a second container connector;

at least one functional module configured to perform at least one electrical function chosen from the group consisting of sensing at least one condition of the beverage, manipulating the at least one condition of the beverage, indicating the at least one condition of the beverage, and combinations thereof; and at least one core module including a power source to provide power for the electrical function; and wherein the at least one functional module and the at least one core module each include an electronic connector configured to electrically connect the at least one functional module and the at least one core module together, and at least one of a first module connector at a top thereof and a second module connector at a bottom thereof enabling any of the at least one functional module and the at least one core module to independently connect to one of the top end and the bottom end of the beverage container mechanically via the first container connector and the second container connector respectively, and enabling the at least one functional module and the at least one core module to be removably connected to each other mechanically, wherein the at least one functional module includes a first module having a temperature sensor configured to sense a temperature of the beverage and a weight sensor configured to sense at least one of a filling time of the beverage into the beverage container and a fill level of the beverage, wherein each of the at least one functional module and the at least one core module each are configured to communicate with another module of the at least one functional module and the at least one core module to send data between the at least one functional module and the at least one core module.

12. The modular drinkware system of claim 11, wherein the at least one functional module further includes at least one heating element configured to heat the beverage in the beverage container.

13. The modular drinkware system of claim 11, wherein the at least one functional module further comprises a third module, and wherein the third module includes a heating element configured to heat the beverage in the beverage container.

14. The modular drinkware system of claim 11, wherein the at least one functional module further includes a second module having a display screen configured to display information relating to the at least one condition of the beverage;

a user interface enabling a user to change information displayed on the display screen; and a light emitting diode (LED) strip configured to emit at least two colored lights to indicate the at least one condition of the beverage.

15. The modular drinkware system of claim 11, wherein the at least one core module further includes at least one of a wireless receiver and a wireless transmitter configured to wirelessly connect with an external computing device; and wherein the modular drinkware system further comprises a software application downloadable to the external computing device and configured to communicate with said at least one of the at least one functional module and the at least one core module, wherein the software application enables parameters to be set relating to the at least one condition of the beverage, and wherein when a parameter is met, an alert is indicated on at least one of the display screen, the LED strip and the external computing device.

16. A modular drinkware system comprising:

a beverage container including an interior for holding a beverage, and a top end opposite a bottom end, the top end including a first container connector and the bottom end including a second container connector;

at least two modules chosen from a group of a plurality of modules, the plurality of modules each including at least one of a first module connector at a top thereof and a second module connector at a bottom thereof enabling any of the plurality of modules to independently connect to one of the top end and the bottom end of the beverage container mechanically via the first container connector and the second container connector respectively, and enabling the plurality of modules to be removably connected to each other mechanically, each module from the plurality of modules configured to perform at least one respective electrical function, wherein at least one of the at least two modules includes a power source to provide power for the electrical function and at least one of a wireless receiver and a wireless transmitter configured to wirelessly connect with an external computing device; and a software application downloadable to the external computing device and configured to communicate with said at least one of the at least two modules, wherein the software application enables parameters to be set relating to the at least one condition of the beverage in the beverage container, and wherein when a parameter is met, an alert is indicated on at least the external computing device, wherein the plurality of modules includes a first module including:

a temperature sensor configured to sense a temperature of the beverage and a weight sensor configured to sense at least one of a filling time of the beverage into the beverage container and a fill level of the beverage, wherein each module of the plurality of modules are configured to communicate with the remaining modules to send data between the plurality of modules.

17. The modular drinkware system of claim 16, wherein the plurality of modules includes a second module including:

a display screen configured to display information relating to the at least one condition of the beverage, a user interface enabling a user to change information displayed on the display screen, and a light emitting diode (LED) strip configured to emit at least two colored lights to indicate the at least one condition of the beverage; and wherein when a parameter is met, an alert is indicated on at least one of the display screen, the LED strip and the external computing device.

* * * * *